United States Patent [19]

Machii et al.

[11] Patent Number: 4,484,885

[45] Date of Patent: Nov. 27, 1984

[54] PULSE COMBUSTION BURNER

[75] Inventors: Norihisa Machii, Kobe; Atsushi Manago, Yao; Sadao Narukawa, Amagasaki, all of Japan

[73] Assignee: Osaka Gas Company Ltd., Osaka, Japan

[21] Appl. No.: 502,358

[22] Filed: Jun. 8, 1983

[51] Int. Cl.[3] ..... F23C 11/04

[52] U.S. Cl. ..... 431/1; 431/354; 60/39.77

[58] Field of Search ..... 431/1, 350, 354; 122/24; 60/249, 39.76, 39.77; 123/188 B, 188 C; 137/479

[56] References Cited

U.S. PATENT DOCUMENTS

| | | | |
|---|---|---|---|
| 1,811,654 | 6/1931 | Shepherd | 122/24 X |
| 2,653,805 | 9/1953 | Scherberg | 60/39.77 X |
| 2,687,614 | 8/1954 | Goddard | 60/39.77 |
| 2,825,203 | 3/1958 | Bertin et al. | 60/39.77 X |
| 4,080,149 | 3/1978 | Wolfe | 431/1 |
| 4,193,773 | 3/1980 | Staudinger | 431/354 X |

FOREIGN PATENT DOCUMENTS

| | | | |
|---|---|---|---|
| 458176 | 9/1949 | Italy | 431/1 |
| 731181 | 4/1980 | U.S.S.R. | 431/1 |

*Primary Examiner*—Randall L. Green
*Attorney, Agent, or Firm*—Edwin E. Greigg

[57] ABSTRACT

A burner for a pulse combustion apparatus according to this invention comprises a plurality of small diameter air passages distributed in cross-sectional directions of a combustion air feed duct. These small diameter air passages are defined by small diameter pipes each provided with fuel gas jet openings to allow air and gas to mix with each other well therein prior to entry to a combustion chamber downstream of the small diameter air passages. Explosions occur intermittently and automatically in the combustion chamber.

3 Claims, 6 Drawing Figures

PULSE COMBUSTION BURNER

BACKGROUND OF THE INVENTION

This invention relates to burners of pulse combustion apparatus, and more particularly to a burner of a pulse combustion apparatus comprising a fuel gas feed duct and a combustion air feed duct connected to one end of a combustion chamber through reverse flow check valve means, and a tail pipe connected to the other end of the combustion chamber and defining an exhaust gas discharge duct. In such a burner a dynamic inertia resulting from an explosion draws fuel gas and combustion air into the combustion chamber for a next explosion.

The above pulse combustion apparatus has various advantages. It does not require energy for supplying air or for ignition except at start, and yet is capable of high load combustion. The tail pipe may be long and thin since the apparatus provides exhaust gas at a very high pressure though in a pulsating manner. Therefore this apparatus is useful, for example, in heating fluid efficiently by utilizing the tail pipe.

FIG. 5A of the accompanying drawings shows a prior art construction including a burner head A for supplying fuel gas and combustion air. This construction has a disadvantage of providing a small heat output despite a large capacity combustion chamber 1. To be particular, with this known burner head the fuel gas is introduced as peripherally distributed into a pipe portion 14 having a smaller diameter than the combustion chamber 1, and therefore a greater pressure loss occurs at entry to the combustion chamber 1 of a mixture of the air coming in from an air feed duct 3 and the fuel gas from the burner head A. Consequently, the fuel is supplied in a small amount in this apparatus, which results in a small heat output relative to the large combustion chamber 1.

The above disadvantage may be overcome, for example, by enlarging the diameter of the combustion air feed duct 3 to be substantially equal to that of the combustion chamber as shown in FIG. 5B. But then the diameter of the burner head A too will have to be enlarged as shown, in order to obtain a good mixture of the combustion air and the fuel gas. Such a construction does not provide a satisfactory solution to the problem because there will only be an insufficient supply of the gas/air mixture in a combustion chamber portion B adjacent to the end face of the burner head A.

SUMMARY OF THE INVENTION

Having regard to the above state of the art, an object of this invention is to provide an improved burner head which allows the combustion air and the fuel gas to mix with each other well and the resulting fuel mixture to be supplied to the entire combustion chamber uniformly and in a sufficient quantity. Another object of the invention is to provide a burner of a pulse combustion apparatus which, with a substantially increased combustion load, is compact and yet has a great heating power.

A further object of this invention is to provide a burner of a pulse combustion apparatus comprising a plurality of small diameter air passages distributed in cross-sectional directions of the combustion air feed duct, each of the small diameter air passages being opposed to terminal openings of the fuel gas feed duct.

Thus, in the burner according to this invention combustion air is distributed into the plurality of small diameter air passages and the air and fuel gas mix with each other in each of the small diameter air passages. In other words, a good gas/air mixture is obtained in the narrow passages and a large amount of the fuel is drawn into the combustion chamber owing to a small flow resistance. Moreover, the distributed arrangement of the small diameter air passages as described above assures a uniform supply of the fuel over the entire combustion chamber, whereby the capacity of the combustion chamber is used effectively and to the full and a high load combustion takes place in a stable manner at a low excess air ratio. Thus, a compact and high power pulse combustion apparatus may be realized by employing the burner embodying this invention.

Other objects and advantages of this invention will be apparent from the following description.

BRIEF DESCRIPTION OF THE DRAWINGS

The drawings illustrate burners of pulse combustion apparatus according to this invention, in which.

DETAILED DESCRIPTION OF THE PREFERRED EMBODIMENTS

This invention is hereinafter described with reference to the accompaying drawings.

Figure 1:
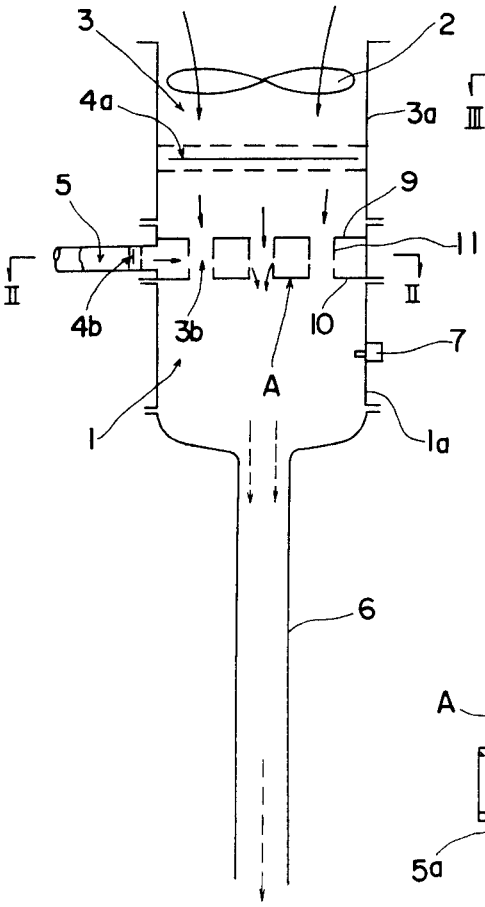
FIG. 1 is a schematic view in vertical section showing a pulse combustion apparatus.

A pulse combustion apparatus shown in FIG. 1 comprises a combustion chamber 1 and a combustion air feed duct 3 including an electric fan 2 and connected to the top of the chamber 1 through a reverse flow check valve means 4*a*. A fuel gas feed duct 5 having a reverse flow check valve means 4*b* is connected to the combustion chamber 1 adjacent the top end thereof. The bottom of the combustion chamber 1 is connected with a straight tail pipe 6 defining a discharge duct for an exhaust gas produced by combustion. The combustion chamber 1 also includes a starter ignition plug 7.

The above pulse combustion apparatus operates as follows: When starting the apparatus, the electric fan 2 is put into motion to feed combustion air to the combustion chamber 1, the air thereby being mixed with fuel gas in said chamber at a suitable mixture ratio so that an explosion is caused therein by means of the ignition plug 7. Then a dynamic inertia of exhaust gas resulting from the explosion draws the fuel gas and the combustion air from the two feed ducts 3 and 5 into the combustion chamber 1. Thereafter part of the hot exhaust gas flows from the tail pipe 6 back to the combustion chamber 1 by virtue of reaction after the explosion. A further explosion is caused by a heat energy of the exhaust gas or by stagnant flames at the burner head. This cycle is repeated. It is to be understood that the electric fan 2 and the ignition plug 7 are put out of operation upon stabilization of the pulse combustion.

Figure 2:
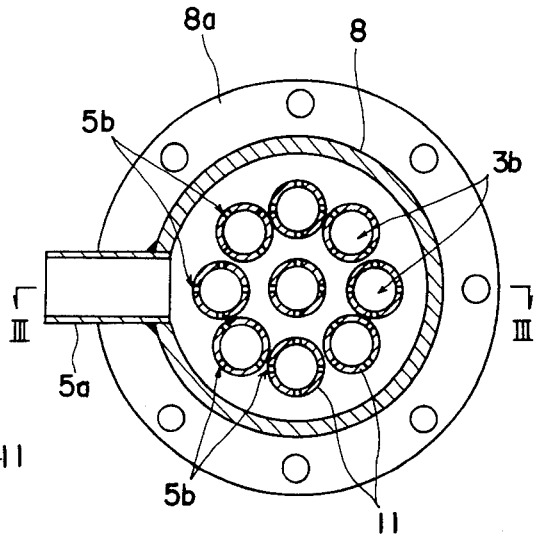
FIG. 2 is a sectional view taken on line II—II of FIG. 1.
Figure 3:
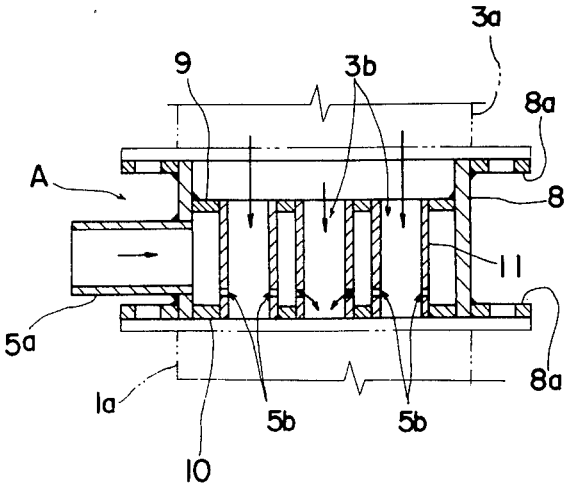
FIG. 3 is a sectional view taken on line III—III of FIG. 2.

Description is given hereinafter of the detailed construction of the burner head A for mixing the combustion air and the fuel gas coming in from the two feed ducts 3 and 5. As shown in FIGS. 2 and 3, a pipe 8 is provided having flanges 1*a* at respective ends thereof for coupling by bolts to a pipe 3*a* defining the combustion air feed duct 3 and to a housing 1*a* defining the combustion chamber 1. This pipe 8 includes two perforated discs 9 and 10 traversing an interior space thereof and spaced away from and opposed to each other. A plurality of small diameter pipes 11 are provided to fit in the perforations of the discs 9 and 10 and extend substantially parallel to each other and to an axis of the pipe 8. These small diameter pipes define small diameter air passages 3*b*, respectively. In other words, the small diameter air passages 3*b* are arranged parallel to one another and distributed in cross-sectional directions of the combustion air feed duct 3. A fuel gas delivery pipe 5*a* is connected to the pipe 8 in a manner to communicate with a space surrounded by the pipes 8 and 11 and the discs 9 and 10. Each of the small diameter pipes 11 is provided with terminal openings or gas jet openings 5*b* of the fuel gas feed duct 5 at a distance of about 5–30 mm from a surface of the disc 10 opposed to the combustion chamber 1. Thus the gas jet openings are in communication with the fuel gas feed duct 5 across the above-mentioned space. The fuel gas issuing from the gas jet openings mixes into the combustion air flowing through the small diameter air passages 3*b* at an average velocity of about 10 m/sec. Consequently the resulting gas mixture is supplied to the combustion chamber 1 in a distributed manner.

It is to be noted that the exhaust gas resulting from an explosion of the gas mixture must be prevented from flowing back to a space upstream of the disc 9, for such a reverse flow of exhaust gas would disturb a timing in which a fresh gas mixture flows into the combustion chamber. To avoid this trouble, the ratio L/D of the length L of the small diameter pipes with respect to the inside diameter D thereof should desirably be 2 or more. Further, to prevent a reverse flow beyond the disc 9 as noted above, the gas jet openings 5*b* should desirably be located as close to the downstream disc 10 as possible. However, a sufficient distance must be provided between the jet openings 5*b* and the disc 10 in order to assure good mixture of the air and the fuel. Thus, the jet openings 5*b* are located slightly below or downwstream of a mid-point vertically of the pipes 11 as in the drawings.

Figure 4:
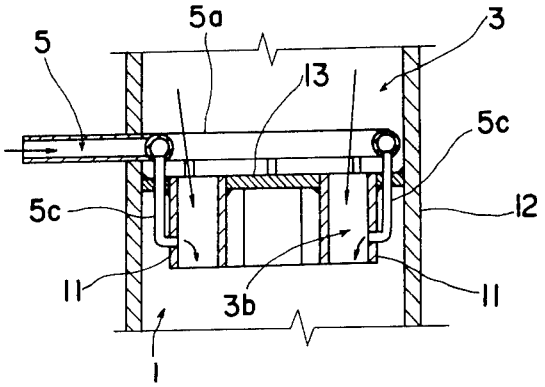
FIG. 4 is a sectional view of a modified embodiment.
Figure 5A:
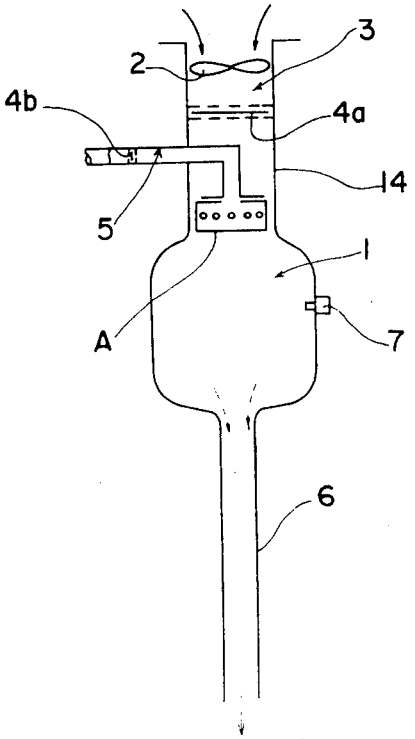
Fig. 5A (PRIOR ART)
FIGS. 5A and 5B are schematic views in vertical section each showing an example of apparatus for comparison purposes.
Figure 5B:
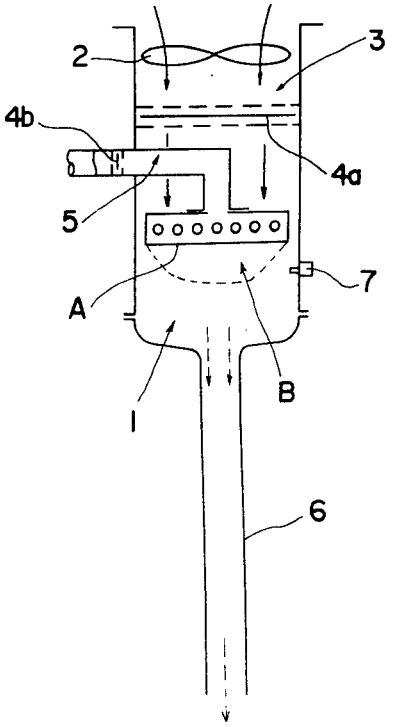
Fig. 5B (PRIOR ART)

The small diameter air passages 3*b* may be attached in a varied manner without being limited to the manner described above. It is also possible to vary, as desired, the gas passage from the fuel gas feed duct 5 to the gas jet openings 5*b* of the small diameter air passages 3*b*. As shown in FIG. 4, for example, one perforated disc 13 is mounted to traverse a housing 12 defining the combustion chamber 1 and the combustion air feed duct 3, and a plurality of small diameter pipes 11 defining small diameter air passages 3*b* are fitted in the perforations in the disc 13. A fuel gas delivery pipe 5*a* extends into the housing 12, and is connected to the respective small diameter pipes 11 by branch pips 5*c*.

The tail pipe 6 may be varied in number, shape and dimension as desired. Generally a muffler is connected to the tail pipe 6.

Efficient use may be made of a pulse combustion apparatus incorporating the burner according to this invention for varied heating purposes such as for heating a fluid by disposing the tail pipe 6 or the like in the fluid, or for utilizing energy of the exhaust gas.

We claim:

1. A pulse combustion apparatus comprising:

a cylindrical combustion chamber having a fuel-air inlet end and an exhaust end, a tail pipe having a much smaller diameter than said combustion chamber is connected to said exhaust end of said combustion chamber, a fuel gas duct connected to said inlet end of said combustion chamber, a combustion air feed duct connected to said fuel gas duct to feed air thereto, a reverse flow check valve means in said combustion air feed duct upstream of said fuel gas duct, a fuel gas delivery pipe connected to said fuel gas duct for feeding fuel thereto, a reverse flow check valve means in said fuel gas delivery pipe, said fuel gas duct comprising oppositely disposed, spaced, perforated disc secured in said fuel-air inlet end perpendicular to its axis and in parallelism with one disc upstream of said fuel gas delivery pipe and one disc downstream of said fuel gas delivery pipe, a plurality of small diameter pipes secured at their upstream and downstream ends in an airtight manner in said perforations in said spaced disc and arranged in said gas fuel duct in parallelism with each other and perpendicular to said disc with their upstream end open to said air feed duct and their downstream end open to said combustion chamber, the inside of said small diameter pipes defines said fuel gas duct, said fuel gas duct and said spaced discs forming a fuel feed space surrounding said small diameter pipes which are secured to said discs, said fuel feed space communicating with said fuel gas delivery pipe, each of said small diameter pipes including a plurality of transverse gas jet openings that communicate with said fuel feed space to permit fuel flow from said fuel feed space to mix with air flow through said small diameter pipes from said air feed duct to said combustion chamber.

2. A pulse combustion apparatus as claimed in claim 1 wherein said small diameter pipes have flush air intake ends equidistant from said reverse flow check valve means in said air feed duct and flush outlet ends, each of said small diameter pipes including at least four of said gas jet openings spaced at equal intervals in the same plane.

3. A pulse combustion apparatus as claimed in claim 2 wherein a ratio of a length of said small diameter pipes with respect to an inside diameter thereof is at least 2:1, and said gas jet openings are disposed downstream of midpoints of said small diameter pipes relative to air flow.

* * * * *